US008734274B1

(12) United States Patent
Hochberg

(10) Patent No.: US 8,734,274 B1
(45) Date of Patent: May 27, 2014

(54) COLLAPSIBLE, TIP RESISTANT TEE BALL STAND

(75) Inventor: Seth Hochberg, Plainville, MA (US)

(73) Assignee: Franklin Sports, Inc., Stoughton, MA (US)

( * ) Notice: Subject to any disclaimer, the term of this patent is extended or adjusted under 35 U.S.C. 154(b) by 146 days.

(21) Appl. No.: 13/433,576

(22) Filed: Mar. 29, 2012

(51) Int. Cl.
*A63B 71/00* (2006.01)

(52) U.S. Cl.
USPC ..... 473/417

(58) Field of Classification Search
CPC ..... A63B 69/00; A63B 69/0002; A63B 2069/0004; A63B 2069/0008
USPC ..... 473/417, 422, 423, 451
See application file for complete search history.

(56) References Cited

U.S. PATENT DOCUMENTS

| | | | | |
|---|---|---|---|---|
| 2,884,250 | A * | 4/1959 | Patterson | 473/423 |
| 4,227,691 | A | 10/1980 | Lefebvre et al. | |
| 4,383,686 | A | 5/1983 | Cardieri | |
| 4,445,685 | A | 5/1984 | Cardieri | |
| 4,664,374 | A | 5/1987 | Groves | |
| 4,709,924 | A | 12/1987 | Wilson et al. | |
| 4,819,937 | A | 4/1989 | Gordon | |
| 4,886,267 | A | 12/1989 | Licciardi et al. | |
| 4,962,924 | A | 10/1990 | James | |
| 5,004,234 | A | 4/1991 | Hollis | |
| 5,100,134 | A * | 3/1992 | Becker | 473/417 |
| 5,388,823 | A | 2/1995 | Prieto | |
| D373,806 | S | 9/1996 | Bunnell | |
| 5,897,444 | A | 4/1999 | Hellyer | |
| D410,052 | S | 5/1999 | Davis et al. | |
| 5,916,045 | A | 6/1999 | Busch | |
| 6,099,418 | A | 8/2000 | Owen | |
| 6,238,307 | B1 | 5/2001 | Owen | |
| 6,358,163 | B1 * | 3/2002 | Tanner | 473/417 |
| 6,413,175 | B1 | 7/2002 | Mooney, Jr. | |
| 6,884,185 | B2 | 4/2005 | Udwin et al. | |
| D514,638 | S | 2/2006 | deGrasse | |
| 7,063,632 | B2 | 6/2006 | Green | |
| 7,226,372 | B2 * | 6/2007 | Flanigan | 473/417 |
| 7,281,998 | B2 * | 10/2007 | Tanner | 473/417 |
| 7,479,074 | B1 | 1/2009 | Pierce | |
| 7,641,573 | B2 | 1/2010 | Cech | |
| 7,662,052 | B1 * | 2/2010 | Vidrine | 473/422 |
| 7,744,496 | B2 | 6/2010 | Chisena | |
| D633,583 | S | 3/2011 | Guevara | |
| 8,162,780 | B2 * | 4/2012 | Wang | 473/417 |
| 8,257,202 | B1 * | 9/2012 | Stanek | 473/417 |
| 2006/0019773 | A1 * | 1/2006 | Newman | 473/417 |
| 2006/0205540 | A1 * | 9/2006 | Liu | 473/417 |
| 2009/0082140 | A1 * | 3/2009 | Liao | 473/417 |
| 2010/0016100 | A1 * | 1/2010 | Liu et al. | 473/417 |
| 2010/0056306 | A1 * | 3/2010 | Chen | 473/417 |
| 2011/0281671 | A1 * | 11/2011 | Chen | 473/417 |
| 2012/0052986 | A1 * | 3/2012 | Quinn | 473/417 |
| 2012/0172153 | A1 * | 7/2012 | Newman | 473/417 |
| 2013/0178313 | A1 * | 7/2013 | Meier et al. | 473/417 |

* cited by examiner

*Primary Examiner* — Mitra Aryanpour
(74) *Attorney, Agent, or Firm* — Joseph B Bowman

(57) ABSTRACT

A tee ball stand with an adjustable length ball support stanchion having a thin fiber wand as a section thereof which readily deflects when the stanchion is struck by an errant blow from a bat and which then causes the support stanchion to return to an upright position. The lower end of the stanchion is connected to an X-frame base which is tip resistant and which may be readily disassembled or collapsed for lineal storage alongside the upright stanchion in a tube or sleeve. A double layered, fabric cone is connected to the upper end of the stanchion to support a ball. The ball support cone readily deflects if struck by a bat and returns to its original shape.

22 Claims, 5 Drawing Sheets

COLLAPSIBLE, TIP RESISTANT TEE BALL STAND

CROSS-REFERENCE TO RELATED APPLICATIONS

This application has no related applications.

STATEMENT REGARDING FEDERALLY SPONSORED RESEARCH OR DEVELOPMENT

The inventions described and claimed in this application were not made under federally sponsored research and development.

BACKGROUND OF THE INVENTION

This invention relates to a tee ball stand. More specifically, this invention relates to a tee ball stand which is fully collapsible for lineal storage and which is tip resistant when inadvertently struck instead of the ball itself.

Tee ball stands are characteristically used in the process of teaching young children to hit a ball with a bat. The typical tee ball stand comprises a flat, ground engaging plate, most often in the shape of a baseball home plate, which supports an adjustable vertical pole having a ball support cup on the upper end. A ball is placed on the support cup so a youngster can then strike at the stationary ball by swinging a bat instead of the more difficult task of attempting to hit a moving ball. With limited experience or limited coordination, the youngster may occasionally strike the cup or pole holding the ball, rather than the ball itself. This can be expected as part of the learning process. As a result, however, the tee ball stand is frequently tipped over or moved and has to be repositioned for the training session to continue. This can be a source of frustration and discouragement, as well as a safety concern, for the youngster and coach in the event of inadvertent contact with errant bat swings.

U.S. Pat. Nos. 4,227,691, 4,709,924, 4,819,937, 4,962,924, 5,004,234, 5,916,045, 6,099,418 and 6,884,185, as well as others, are characteristic of various tee ball practice devices having a base plate that rests flat on the ground to support some type of ball holding apparatus.

Even though some of the prior art references disclose a telescopingly adjustable vertical pole, one can easily appreciate the problem of storing a tee ball stand with a large base plate when the equipment is not in use.

Therefore, a need remains in the field of youth sports for a tee ball stand that can be easily and quickly assembled from a condition of compact lineal storage and that will be tip resistant when inadvertently struck with a bat. The primary objective of this invention is to meet these needs.

SUMMARY OF THE INVENTION

More specifically, an object of the invention is to provide a lightweight tee ball stand that will yield from an upright orientation in the event it is struck with an errant bat of a youngster so as to protect the user from experiencing the shock of impact, but, at the same time, the tee ball stand will remain fixed at a preselected location on the ground.

Another object of the invention is to provide a tee ball stand with an upright stanchion including a resiliently flexible portion to readily deflect when struck by an errant blow of a bat and then return to an upright position.

Another object of the invention is to provide a tee ball stand of the character described wherein the upright stanchion is telescopically adjustable to accommodate youngsters of varying heights and wherein the upright stanchion can be collapsed to a minimum height for storage.

A further object of the invention is to provide a tee ball stand with a tip resistant base easily assembled or disassembled for lineal storage alongside the upright stanchion in a tube or sleeve.

An additional object of the invention is to provide a durable, but resiliently deflectable ball support for a tee ball stand which has minimal influence on the flight of the ball when the ball is struck by a bat, and which readily deflects and returns to its original shape if inadvertently struck by a bat.

In summary, an object of the invention is to provide a tee ball stand with an adjustable length ball support stanchion having a thin fiber wand as a section thereof which readily deflects when the stanchion is struck by an errant blow from a bat and which then causes the support stanchion to return to an upright position. The lower end of the stanchion is connected to an X-frame base which is tip resistant and which may be readily disassembled or collapsed for lineal storage alongside the upright stanchion in a tube or sleeve. A double layered, fabric cone is connected to the upper end of the stanchion to support a ball. The ball support cone readily deflects if struck by a bat and returns to its original shape.

Other and further objects of the invention, together with the features of novelty appurtenant thereto, will appear in the course of the detailed description of the drawings.

BRIEF DESCRIPTION OF THE DRAWINGS

In the following description of the drawings, in which like reference numerals are employed to indicate like parts in the various views.

DETAILED DESCRIPTION OF THE DRAWINGS

Referring to the first embodiment of the invention in greater detail, attention is directed to FIGS. 1-4. The tee ball stand includes an upright ball support stanchion, generally designated by the numeral 10, connected to a ground engaging base, generally designated by the numeral 12, to hold the stanchion 10 in a substantially vertical orientation perpendicular to the ground.

Figure 3:
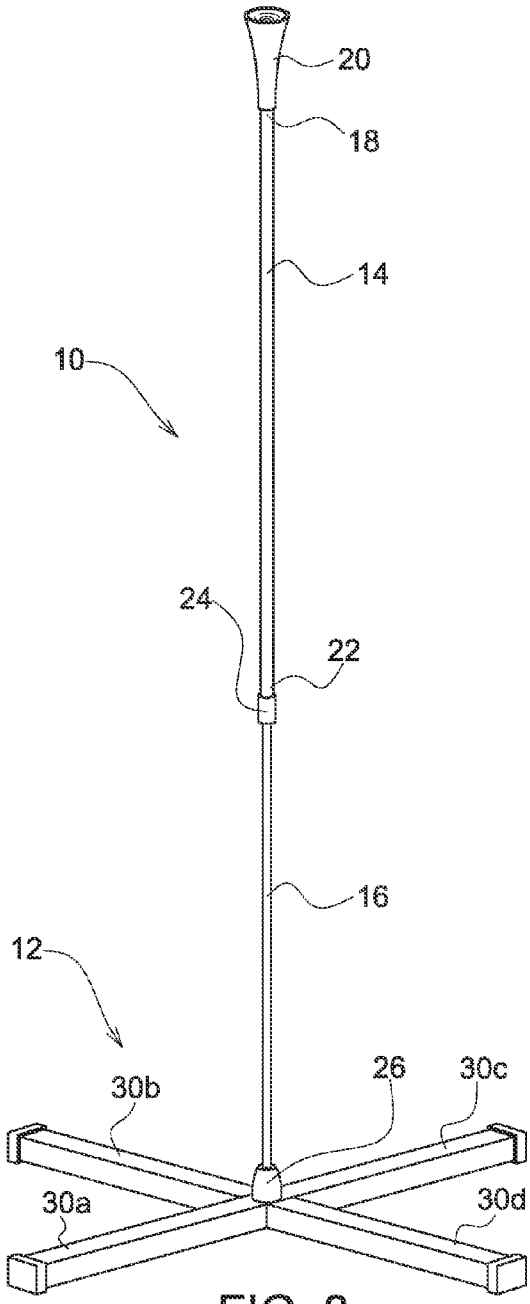
FIG. 3 is a perspective view similar to FIG. 1 but showing the upright stanchion fully extending for use in batting practice.

As best understood with reference to FIG. 3, the stanchion 10 includes an upper pipe section 14 which telescopically receives therein a lower, flexible wand section 16 to permit the overall height of the stanchion 10 to be adjusted in accordance with the stature of the batter using the equipment. The upper pipe section 14 is substantially rigid and has an upper end 18 to which is attached a ball support cup 20 molded of rubber or durable plastic material. The upper pipe section 14 also has a lower end 22 to which is attached a friction fitting 24 to tightly receive the wand section 16 and thereby adjustably fix the wand section 16 to the pipe section 14 at a preselected height. The wand section 16 is formed from a fiberglass or carbon fiber rod which is relatively thin in order to readily deflect to absorb the impact when any portion of the stanchion 10 is struck by the errant blow of a bat and to then cause the stanchion 10 to return to an upright, vertical orientation as illustrated in FIG. 3.

The lowermost end of the wand section 16 includes a base connection member 26 having a downwardly extending threaded bolt 28.

Figure 1:
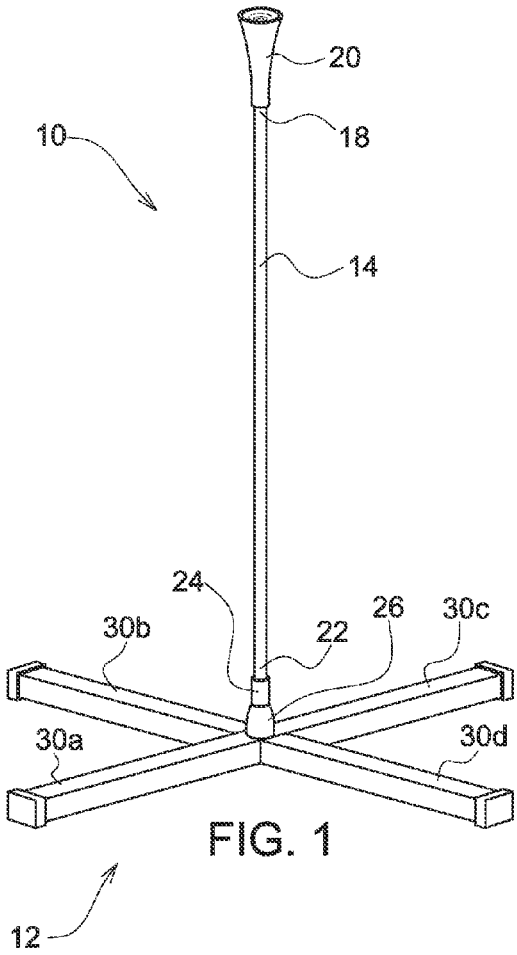
FIG. 1 is a perspective view of a tee ball stand constructed in accordance with one embodiment of the invention with the upright stanchion at minimum height as for storage.
Figure 2:
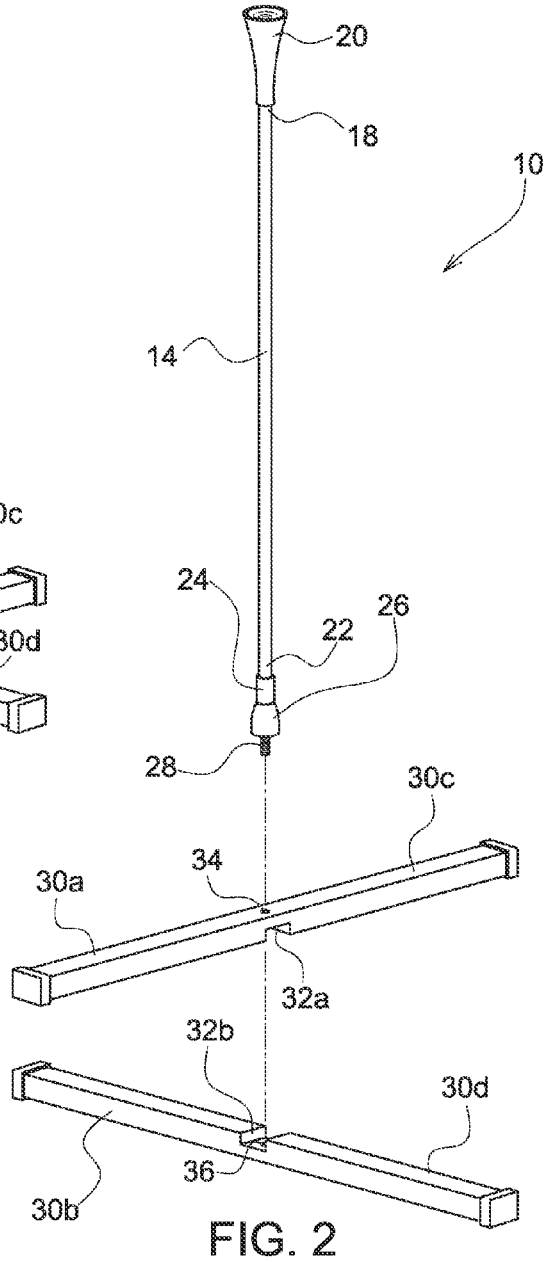
FIG. 2 is an exploded view similar to FIG. 1 but showing disassembly of the base and upright stanchion.

The base 12 is formed as an X-shaped frame of four legs 30*a-d* where each leg is oriented at an angle of approximately ninety degrees with respect to the adjacent leg. Each such leg 30*a-d* is of sufficient length as to prevent the tee ball stand from tipping over in the event that the stanchion 10 is struck by an errant blow of a bat. In the first embodiment of the invention, opposed legs 30*a* & 30*c* and 30*b* & 30*d* are integrally joined centrally or formed from a single piece of square tubing. Intermediate the opposed leg pairs 30*a* & 30*c* or 30*b* & 30*d* are formed interlocking notches 32*a* & 32*b*, respectively. With reference to FIG. 2, the uppermost notch 32*a* includes a hole 34 of sufficient diameter to receive the bolt 28 of the base connection member 26. The lowermost notch 32*b* includes a threaded hole 36 to threadably receive the bolt 28 of the base connection member 26 when the opposed leg pair 30*a* & 30*c* is mated with the opposed leg pair 30*b* & 30*d*.

Figure 4:
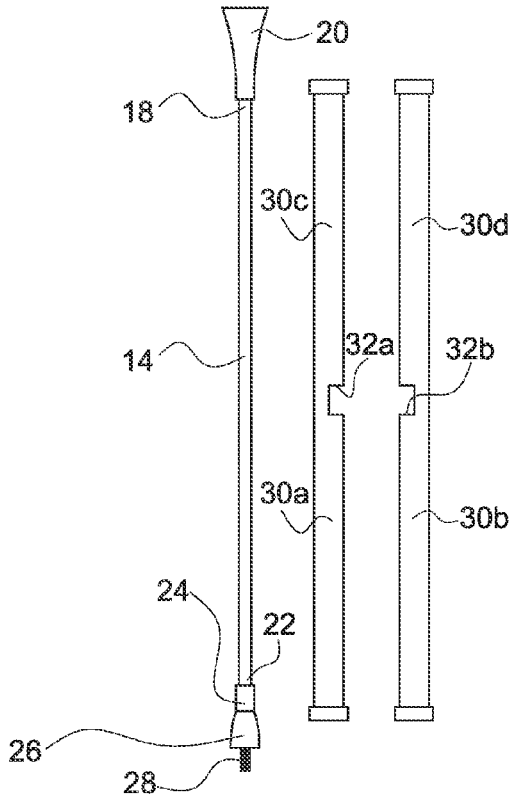
FIG. 4 is a side elevational view illustrating the base and stanchion positioned and arranged in a lineal relationship for storage.

When the stanchion 10 is removed from the base 12 and is telescoped to its minimal height as illustrated in FIG. 4, the opposed leg pairs 30*a* & 30*c* and 30*b* & 30*d* may be lineally aligned in a side-by-side manner alongside the stanchion 10 for convenient storage such as in a tube or sleeve (not shown).

To assemble the tee ball stand from storage, therefore, the notch 32*a* of the opposed leg pair 30*a* & 30*c* is first fitted into the notch 32*b* of the opposed leg pair 30*b* & 30*d*. The bolt 28 on the stanchion 10 is then inserted through the hole 34 of the opposed leg pair 30*a* & 30*c* and screwed into the threaded hole 36 of the opposed leg pair 30*b* & 30*d* to complete the assembly. The tubular pipe section 14 may then be pulled upwardly on the wand section 16 to a sufficient height so as to present the ball support cup 20 at an appropriate hitting zone according to the stature of the user. A ball (not shown) such as a baseball or softball can then be placed on the support cup 20 for batting practice.

In the event the stanchion 10 or support cup 20 is struck by an errant swing of the bat, the wand section 16 deflects to absorb the blow and then cause the stanchion 10 to return to a vertical position. In conjunction with the yieldable nature of the stanchion 10, the legs 30*a-d* of the base 12 are of sufficient length so as to resist tipping over in the event the stanchion 10 experiences a particularly forceful blow from a bat.

Figure 5:
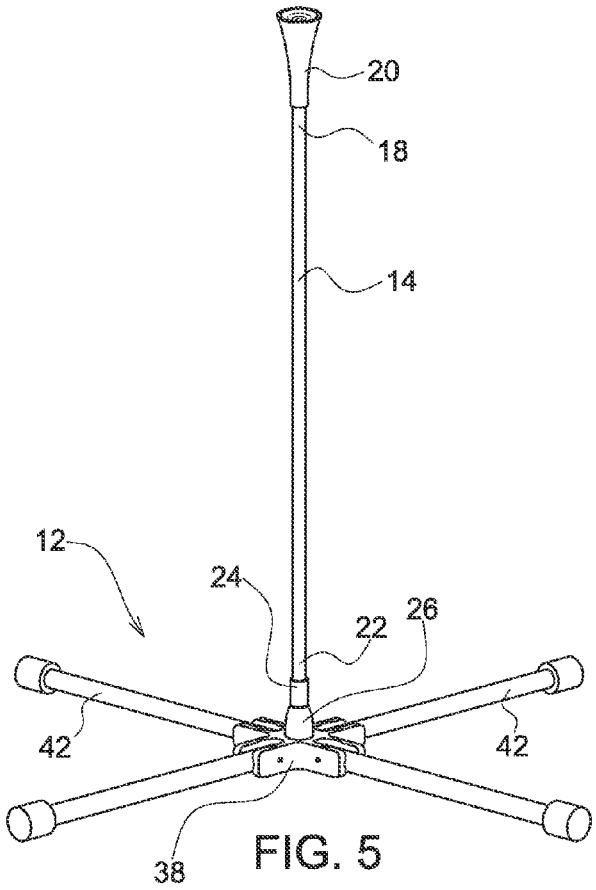
FIG. 5 is a perspective view of a tee ball stand constructed in accordance with a second embodiment of the invention with the upright stanchion at minimum height as for storage.
Figure 6:
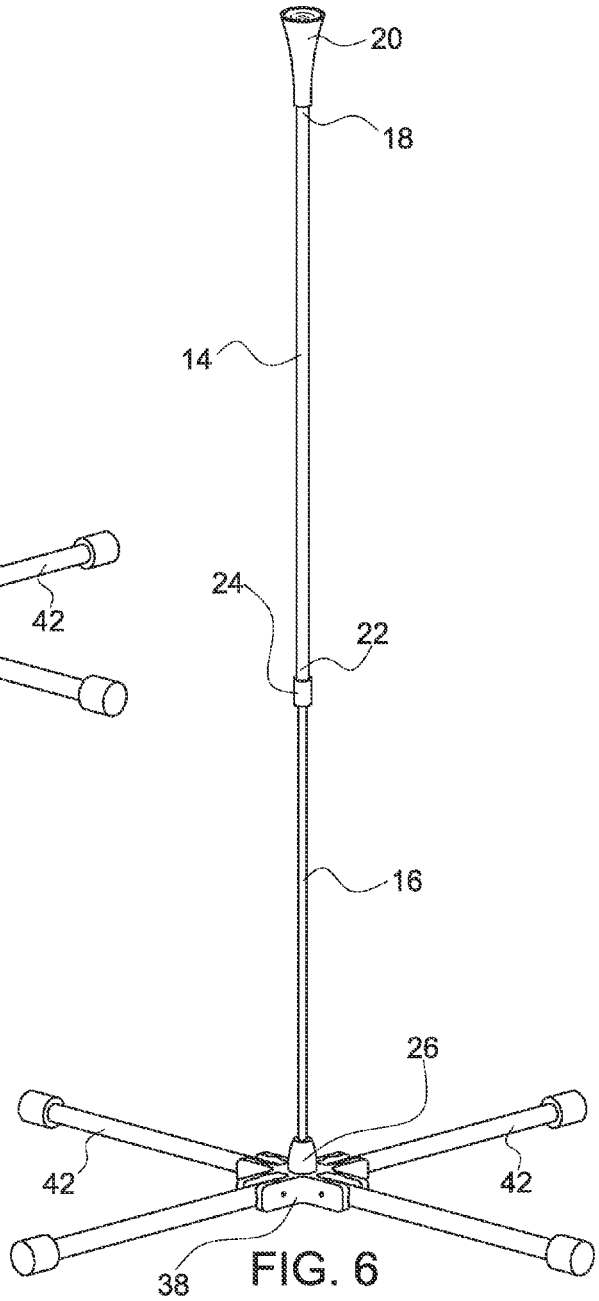
FIG. 6 is a perspective view similar to FIG. 5 but showing the upright stanchion fully extending for use in batting practice.
Figure 7:
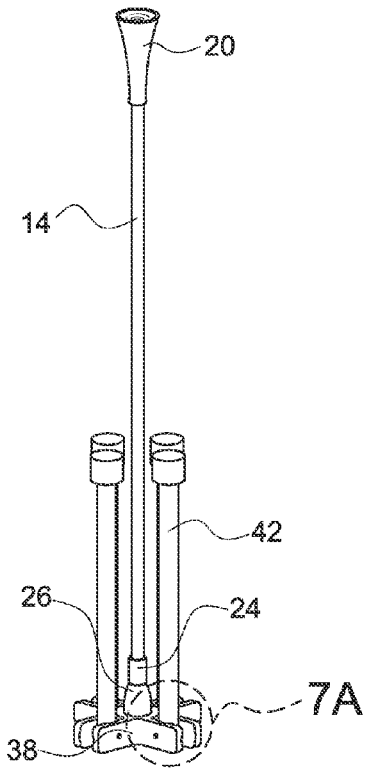
FIG. 7 is a perspective view of the tee ball stand shown in FIGS. 5 & 6 positioned in a storage condition.

Referring to the second embodiment of the invention in greater detail, attention is directed to FIGS. 5-7. The tee ball stand includes an upright ball support stanchion 10 connected to a ground engaging base, generally designated by the numeral 12, to hold the stanchion 10 in a substantially vertical orientation perpendicular to the ground.

Similar to the first embodiment as previously described, the stanchion 10 includes an upper pipe section 14 which telescopically receives therein a lower flexible wand section 16 to permit the overall height of the stanchion 10 to be adjusted in accordance with the stature of the batter using the equipment as illustrated in FIG. 6. The upper pipe section 14 is substantially rigid and has an upper end 18 to which is attached a ball support cup 20 molded of rubber or durable plastic material. The upper pipe section 14 also has a lower end 22 to which is attached a friction fitting 24 to tightly receive the wand section 16 and thereby adjustably fix the wand section 16 to the pipe section 14 at a preselected height. The wand section 16 is formed from a fiberglass or carbon fiber rod which is relatively thin in order to readily deflect to absorb the impact when any portion of the stanchion 10 is struck by the errant blow of a bat and to then cause the stanchion 10 to return to an upright, vertical orientation as illustrated in FIG. 6.

The lowermost end of the wand section 16 includes a base connection member 26 which is securely attached to the base 12.

Figure 7A:
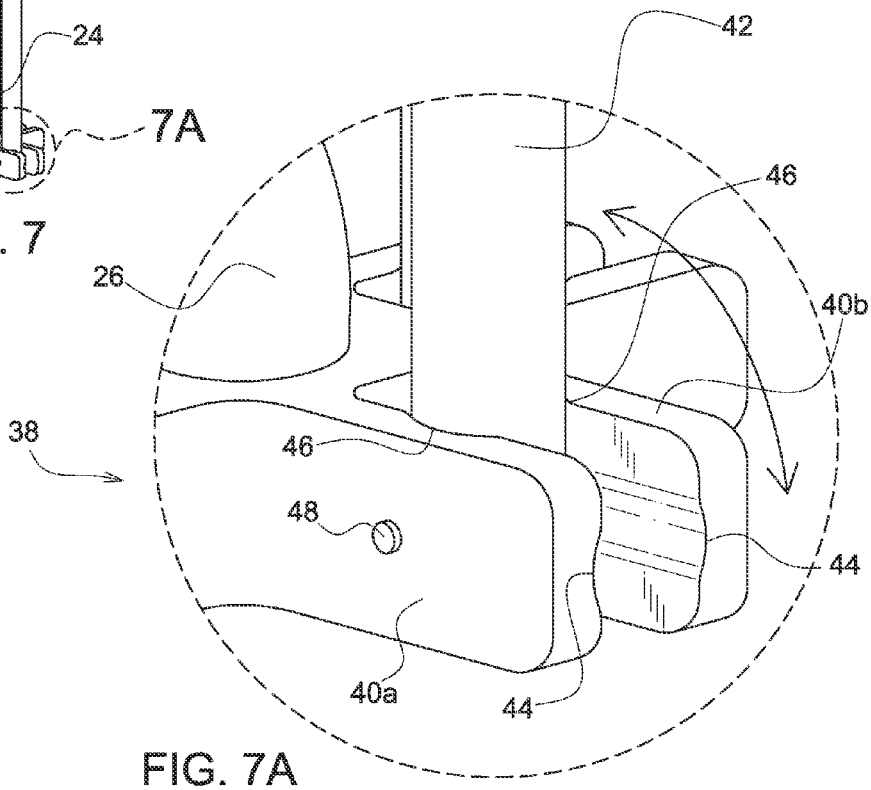
FIG. 7A is an enlarged, fragmentary view from FIG. 7 to illustrate the friction lock of the base legs.

The base 12 includes an X-shaped, central hub 38 having four pairs of wing members where each such pair is oriented at an angle of approximately ninety degrees with respect to the adjacent pair. Pivotally connected between each pair of wing members are tubular legs 42 of sufficient length as to prevent the tee ball stand from tipping over in the event that the stanchion 10 is struck by an errant blow of a bat. As best illustrated in FIG. 7A, the wing members 40*a* & 40*b* of each such pair of wing members have interior surfaces molded with horizontally extending channels 44 and with vertically extending channels 46 so sized to fictionally receive one of the tubular legs 42 between the wing members 40*a* & 40*b*. The tubular leg 42 is carried on a pivot pin 48 extending between the wing members 40*a* & 40*b*. Thus constructed, the wing members 40*a* & 40*b* provide sufficient compressive force to frictionally lock the tubular leg 42 in either a horizontal or vertical position, but permit pivotal movement of the tubular leg 42 on pin 48 between such horizontal and vertical positions as indicated by the arrows in FIG. 7A.

When the stanchion 10 is telescoped to its minimal height as illustrated in FIG. 5 or 7, the legs 42 may be pivoted vertically on pivot pins 48 as shown in FIG. 7 and be fictionally captured in the vertical channels 46 of the hub 38 to lineally align in a side-by-side manner alongside the stanchion 10 for convenient storage such as in a tube or sleeve (not shown).

To assemble the tee ball stand from storage, therefore, the legs 42 are pivoted outwardly on the pins 48 and frictionally captured in the horizontal channels 44 of the hub 38. The tubular pipe section 14 may then be pulled upwardly on the wand section 16 to a sufficient height so as to present the ball support cup 20 in an appropriate hitting zone according to the stature of the user. A ball (not shown) such as a baseball or softball can then be placed on the support cup 20 for batting practice.

In the event the stanchion 10 or support cup 20 is struck by an errant swing of the bat, the wand section 16 deflects to absorb the blow and then cause the stanchion 10 to return to a vertical position. In conjunction with the yieldable nature of the stanchion 10, the legs 42 of the base 12 are of sufficient length so as to resist tipping over in the event the stanchion 10 experiences a particularly forceful blow from a bat.

Figure 8:
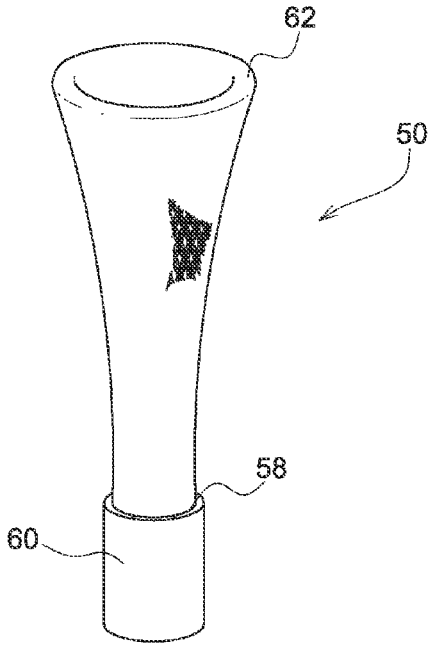
FIG. 8 is a perspective view of an optional ball support cone of a third embodiment of the invention.
Figure 9:
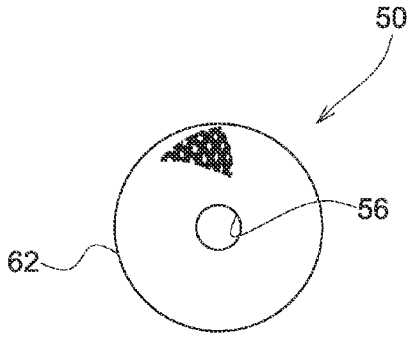
FIG. 9 is a top plan view of the ball support cone illustrated in FIG. 8.
Figure 10:
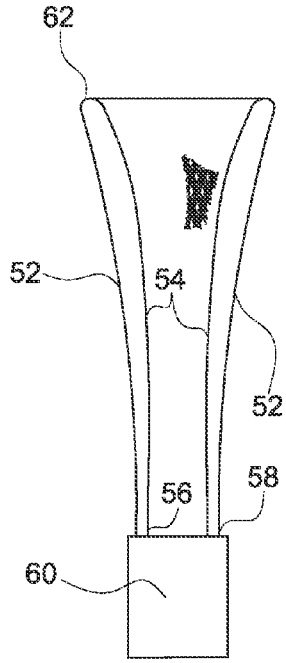
FIG. 10 is a side elevational view of the ball support cone illustrated in FIGS. 8 & 9.

Referring to the third embodiment of the invention in greater detail, attention is directed to FIGS. 8-10 showing an improved ball support member, generally designated by the numeral 50. The ball support member 50 may be attached atop the pipe section 14 at the upper end 18 thereof in the foregoing embodiments of the invention in place of the conventionally molded support cup 20 previously illustrated and described.

The ball support member 50, as shown in the sectional view of FIG. 10, is formed of two spaced apart layers 52 & 54 of open weave, synthetic fabric material such as used in outdoor applications like sun screens, awnings, outdoor furniture and the like. To create the spaced apart layers 52 & 54 of member 50, a tube of open weave, synthetic fabric in a length substantially equal to twice the finished height of the member 50 is invertibly folded onto itself. The lower ends 56 & 58 of the folded tube are gathered and permanently attached to a fitting 60 which, in turn may be connected to the upper end of a stanchion 10 as previously described. Thus constructed, the member 50 has the general form of an inverted cone with a bell shaped mouth 62 having a sufficient diameter to support a ball such as a baseball or softball.

The material of construction of member 50 may typically be a Nylon or polyethylene mesh having a characteristic stiffness when rolled into a cylindrical shape to create a stable support for the ball but still sideways flexibility. The ball support member 50 constructed in the foregoing manner has very little influence on a properly struck ball. However, in the event the member 50 is contacted by an errant swing of the bat, the double layered fabric readily deflects and then returns to its original shape.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

Having thus described my invention, I claim:

1. A tee ball stand comprising:

an upright, elongate stanchion having upper and lower ends and, when in use, having an intended orientation substantially perpendicular to the ground, said stanchion includes a thin, flexible wand section, a tubular section which telescopically receives said wand section, and a fitting connected to said tubular section to secure said tubular section to said wand section at a preselected height;

a ball supporting member at the upper end of said stanchion, said ball supporting member having an original shape being formed of spaced apart layers of a synthetic, open weave fabric tube and shaped as an inverted bell shaped cone with a mouth to support a ball, said ball supporting member being resiliently flexible in order to return to said original shape if struck by a bat, said fabric tube having an inner tubular section and having a continuously integral outer tubular section invertibly folded over said inner tubular section to create two spaced apart layers in which the lower ends of said inner and outer tubular sections are gathered and attached to the upper end of the stanchion and the upper, folded end of the tube forms the mouth of said inverted bell shaped cone;

a base connection fitting at the lower end of said stanchion; and a ground engaging base connected to said base connection fitting at the lower end of said stanchion to support said stanchion in a substantially upright position to receive a ball on said ball supporting member.

2. The tee ball stand as in claim 1, said wand section having upper and lower ends with the lower end of said wand section connected to said base connection fitting and the upper end of said wand section telescopingly received by said fitting connected to said tubular section to secure said tubular section to said wand section at a preselected height which may be adjustably varied to present said ball supporting member attached to the upper end of said tubular section at a preselected height above said base.

3. The tee ball stand as in claim 2, said wand section being constructed of a thin fiber material selected from the group consisting of fiberglass and carbon fiber and being resiliently yieldable in order to cause said wand section, said tubular section, and said ball supporting member to return to a vertical orientation after being deflected.

4. The tee ball stand as in claim 1, said base including an X-shaped frame formed by four legs connected at the inner ends thereof to said base connection fitting such that adjacent legs of said four legs are oriented at an angle of substantially ninety degrees with respect to each other, said legs being of sufficient length to resist tipping over when said stanchion is deflected from a vertical orientation with respect to the ground.

5. The tee ball stand as in claim 4 wherein opposed legs of said four legs are integrally joined at the inner ends thereof to form two leg support pairs, each of said leg support pairs being centrally notched to mate together such that adjacent legs of said four legs are oriented at an angle of substantially ninety degrees with respect to each other when assembled for ground engagement, but when disassembled from each other said leg support pairs may be oriented linearly alongside said stanchion for convenient storage.

6. The tee ball stand as in claim 5, wherein said base connection fitting interlocks said leg support pairs where said pairs are centrally notched for mating engagement.

7. The tee ball stand as in claim 4, said base connection fitting including a central hub with radially spaced leg brackets and each of said four legs being pinned to one of said leg brackets such that said four legs may be locked outwardly for ground engagement in order to support said stanchion in a vertical orientation with respect to the ground, and may be pivoted upwardly for lineal alignment alongside said stanchion for convenient storage.

8. A tee ball stand comprising:

an upright, elongate stanchion having upper and lower ends and, when in use, having an intended orientation substantially perpendicular to the ground;

a ball supporting member at the upper end of said stanchion, said ball supporting member having an original shape being formed of spaced apart layers of a synthetic, open weave fabric tube and shaped as an inverted bell shaped cone with a mouth to support a ball, said ball supporting member being resiliently flexible in order to return to said original shape if struck by a bat, said fabric tube having an inner tubular section and having a continuously integral outer tubular section invertibly folded over said inner tubular section to create two spaced apart layers in which the lower ends of said inner and outer tubular sections are gathered and attached to the upper end of the stanchion and the upper, folded end of the tube forms the mouth of said inverted bell shaped cone;

a base connection fitting at the lower end of said stanchion; and a ground engaging base connected to said base connection fitting at the lower end of said stanchion to support said stanchion in a substantially upright position to receive a ball on said ball supporting member, said base including an X-shaped frame formed by four legs connected at the inner ends thereof to said base connection fitting such that adjacent legs of said four legs are oriented at an angle of substantially ninety degrees with respect to each other, said legs being of sufficient length to resist tipping over when said stanchion is deflected from a vertical orientation with respect to the ground.

9. The tee ball stand as in claim 8 wherein opposed legs of said four legs are integrally joined at the inner ends thereof to form two leg support pairs, each of said leg support pairs being centrally notched to mate together such that adjacent legs of said four legs are oriented at an angle of substantially ninety degrees with respect to each other when assembled for ground engagement, but when disassembled from each other said leg support pairs may be oriented lineally alongside said stanchion for convenient storage.

10. The tee ball stand as in claim 9, wherein said base connection fitting interlocks said leg support pairs where said pairs are centrally notched for mating engagement.

11. The tee ball stand as in claim 8, said base connection fitting including a central hub with radially spaced leg brackets and each of said four legs being pinned to one of said leg brackets such that said four legs may be locked outwardly for ground engagement in order to support said stanchion in a vertical orientation with respect to the ground, and may be pivoted upwardly for lineal alignment alongside said stanchion for convenient storage.

12. The tee ball stand as in claim 8, said stanchion includes a thin, flexible wand section, a tubular section which telescopically receives said wand section, and a fitting connected to said tubular section to secure said tubular section to said wand section at a preselected height.

13. The tee ball stand as in claim 12, said wand section having upper and lower ends with the lower end of said wand section connected to said base connection fitting and the upper end of said wand section stanchion telescopingly received by said fitting connected to said tubular section to secure said tubular section to said wand section at a preselected height which may be adjustably varied to present said ball supporting member attached to the upper end of said tubular section at a preselected height above said base.

14. The tee ball stand as in claim 13, said wand section being constructed of a thin fiber material selected from the group consisting of fiberglass and carbon fiber and being resiliently yieldable in order to cause said wand section, said tubular section, and said ball supporting member to return to a vertical orientation after being deflected.

15. A tee ball stand comprising:

an upright, elongate stanchion having upper and lower ends and, when in use, having an intended orientation substantially perpendicular to the ground;

a ball supporting member at the upper end of said stanchion, said ball supporting member having an original shape being formed of spaced apart layers of synthetic fabric and shaped as an inverted bell shaped cone with a mouth to support a ball, and said ball supporting member being resiliently flexible in order to return to said original shape if struck by a bat, said ball supporting member is formed from an open weave fabric tube having an inner tubular section and having a continuously integral outer tubular section invertibly folded over said inner tubular section to create two spaced apart layers in which the lower ends of the inner and outer tubular sections are gathered and attached to the upper end of the stanchion and the upper, folded end of the tube forms the mouth of said inverted bell shaped cone;

a base connection fitting at the lower end of said stanchion; and a ground engaging base connected to said base connection fitting at the lower end of said stanchion to support said stanchion in a substantially upright position to receive a ball on said ball supporting member.

16. The tee ball stand as in claim 15, said base including an X-shaped frame formed by four legs connected at the inner ends thereof to said base connection fitting such that adjacent legs of said four legs are oriented at an angle of substantially ninety degrees with respect to each other, said legs being of sufficient length to resist tipping over when said stanchion is deflected from a vertical orientation with respect to the ground.

17. The tee ball stand as in claim 16 wherein opposed legs of said four legs are integrally joined at the inner ends thereof to form two leg support pairs, each of said leg support pairs being centrally notched to mate together such that adjacent legs of said four legs are oriented at an angle of substantially ninety degrees with respect to each other when assembled for ground engagement, but when disassembled from each other said leg support pairs may be oriented lineally alongside said stanchion for convenient storage.

18. The tee ball stand as in claim 17, wherein said base connection fitting interlocks said leg support pairs where said pairs are centrally notched for mating engagement.

19. The tee ball stand as in claim 16, said base connection fitting including a central hub with radially spaced leg brackets and each of said four legs being pinned to one of said leg brackets such that said four legs may be locked outwardly for ground engagement in order to support said stanchion in a vertical orientation with respect to the ground, and may be pivoted upwardly for lineal alignment alongside said stanchion for convenient storage.

20. The tee ball stand as in claim 15, said stanchion includes a thin, flexible wand section, a tubular section which telescopically receives said wand section, and a fitting connected to said tubular section to secure said tubular section to said wand section at a preselected height.

21. The tee ball stand as in claim 20, said wand section having upper and lower ends with the lower end of said wand section connected to said base connection fitting and the upper end of said wand section stanchion telescopingly received by said fitting connected to said tubular section to secure said tubular section to said wand section at a preselected height which may be adjustably varied to present said ball supporting member attached to the upper end of said tubular section at a preselected height above said base.

22. The tee ball stand as in claim 20, said wand section being constructed of a thin fiber material selected from the group consisting of fiberglass and carbon fiber and being resiliently yieldable in order to cause said wand section, said tubular section, and said ball supporting member to return to a vertical orientation after being deflected.

* * * * *